US008515307B2

(12) United States Patent
Shmizu

(10) Patent No.: US 8,515,307 B2
(45) Date of Patent: Aug. 20, 2013

(54) PROCESS CARTRIDGE AND IMAGE FORMING APPARATUS

(75) Inventor: Yoshiyuki Shmizu, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 320 days.

(21) Appl. No.: 12/926,045

(22) Filed: Oct. 22, 2010

(65) Prior Publication Data

US 2011/0103828 A1 May 5, 2011

(30) Foreign Application Priority Data

Nov. 5, 2009 (JP) ..... 2009-254116

(51) Int. Cl.
*G03G 21/16* (2006.01)

(52) U.S. Cl.
USPC ..... 399/111

(58) Field of Classification Search
USPC ..... 399/107, 110–113, 119, 120
See application file for complete search history.

(56) References Cited

U.S. PATENT DOCUMENTS

| | | | | |
|---|---|---|---|---|
| 6,836,629 | B2 * | 12/2004 | Miyabe et al. | 399/111 |
| 7,965,958 | B2 | 6/2011 | Tatsumi et al. | |
| 8,095,035 | B2 | 1/2012 | Ooyoshi et al. | |
| 2008/0145108 | A1 | 6/2008 | Yoshida et al. | |
| 2008/0145119 | A1 | 6/2008 | Tatsumi et al. | |
| 2008/0205930 | A1 | 8/2008 | Kawakami et al. | |
| 2008/0219698 | A1 | 9/2008 | Shimizu et al. | |
| 2008/0267661 | A1 | 10/2008 | Yoshida et al. | |
| 2008/0279586 | A1 | 11/2008 | Tatsumi et al. | |
| 2009/0022531 | A1 | 1/2009 | Kubota et al. | |
| 2009/0110430 | A1 | 4/2009 | Kubota et al. | |
| 2009/0154973 | A1 | 6/2009 | Shimizu et al. | |
| 2009/0162101 | A1 | 6/2009 | Yoshida et al. | |
| 2009/0169246 | A1 | 7/2009 | Ooyoshi et al. | |
| 2009/0169265 | A1 | 7/2009 | Yoshida et al. | |

FOREIGN PATENT DOCUMENTS

| | | |
|---|---|---|
| JP | 10-282752 | 10/1998 |
| JP | 2878660 | 1/1999 |
| JP | 2006-048018 | 2/2006 |
| JP | 2008-139818 | 6/2008 |
| JP | 2009-162854 | 7/2009 |

OTHER PUBLICATIONS

Abstract of JP 09-106184 published on Apr. 22, 1997.
Office Action dated Jun. 4, 2012 issued in corresponding Chinese Application No 20101539778.1 and English translation thereof.
Office Action dated Jun. 4, 2012 issued in corresponding Chinese Application No. 201010539778.1 and English translation thereof.

* cited by examiner

*Primary Examiner* — Hoan Tran
(74) *Attorney, Agent, or Firm* — Harness, Dickey & Pierce P.L.C.

(57) ABSTRACT

A process cartridge incorporates a developing device including a rotatable developer carrier for supplying a developer to an electrostatic latent image formed on a latent image carrier. The process cartridge includes: a bearing that supports a rotating shaft of the developer carrier; and a pressing unit that presses the bearing toward the latent image carrier. A notch having an opening, which extends over a part of a circumference of the rotating shaft, is formed on the bearing, and the notch portion is used as an attachment and removal portion of the rotating shaft.

18 Claims, 6 Drawing Sheets

PROCESS CARTRIDGE AND IMAGE FORMING APPARATUS

CROSS-REFERENCE TO RELATED APPLICATIONS

The present application claims priority to and incorporates by reference the entire contents of Japanese Patent Application No. 2009-254116 filed in Japan on Nov. 5, 2009.

BACKGROUND OF THE INVENTION

1. Field of the Invention

The present invention relates to a process cartridge and an image forming apparatus, and more particularly, to a configuration of a developing unit used to supply a developer to a latent image carrier.

2. Description of the Related Art

In an image forming apparatus using an electrophotographic process, image formation is performed by performing a charging process, an exposure process, a developing process, and a transfer process on a photosensitive element used as a latent image carrier.

A developing device including a developing sleeve which is opposed to the photosensitive element is used to supply a developer to the photosensitive element.

A two-component developer which is a mixture of toner and a carrier or a single-component developer which contains no carrier is used in the developing device; even when either one of the developers is used, the developer is carried on the surface of the developing sleeve in the developing device.

The developer carried on the developing sleeve as a developer carrier is maintained at a predetermined layer thickness on the surface of the developing sleeve, and comes in contact with the surface of the photosensitive element.

In the supply of the developer from the developing sleeve to the photosensitive element, there is known a configuration that the developing sleeve is placed to be opposed to the photosensitive element leaving a slight space between them, and the developer is sequentially supplied to the photosensitive element in accordance with the rotation of the developing sleeve, and at the same time, the toner contained in the developer is electrostatically transferred to an electrostatic latent image on the photosensitive element by the application of a developing bias (for example, Japanese Patent Application Laid-open No. H10-282752).

On the other hand, a gear mounted on one end of a rotating shaft in an axial direction is used to drive the developing sleeve in most cases.

In the case where a gear used to drive the developing sleeve is mounted on one end of the rotating shaft in the axial direction, when a driving force acts, the acting force in a radial direction with respect to the rotating shaft differs between both ends of the rotating shaft in the axial direction, i.e., an end which is subject to the driving force and the other end which is not subject to the driving force. Therefore, in the case of a developing sleeve integrated with a rotating shaft mounting thereon a gear as described above, a gap between the developing sleeve and the opposed photosensitive element may vary along the axial direction. This means it becomes in a state where an axis line of the rotating shaft is distorted in the axial direction, and the position of the axis line of the developing sleeve with respect to the photosensitive element is misaligned, and as a result, the gap between the developing sleeve and the photosensitive element varies with location in the axial direction.

Consequently, to resolve such a problem, there has been proposed a configuration that the developing sleeve is pressed toward the shaft center of the photosensitive element thereby preventing a variation in the gap between the developing sleeve and the photosensitive element (for example, Japanese Patent Application Laid-open No. H10-282752).

In addition, as another configuration for preventing a variation in the gap, there has been proposed a configuration that a bearing for supporting the rotating shaft of the photosensitive element is made to have the same outer diameter as the photosensitive element, and a bearing for supporting the rotating shaft of the developing sleeve is made to have a larger outer diameter than that of the developing sleeve and is pressed against the outer circumferential surface of the bearing of the photosensitive element by application of bias by an elastic body, such as a spring, thereby making a gap between the developing sleeve and the photosensitive element equal to a difference between the outer diameter of the bearing of the developing sleeve and the outer diameter of the bearing of the photosensitive element (for example, Japanese Patent No. 2878660).

Furthermore, as a configuration for equalizing the above-mentioned pressing/biasing force of the developing sleeve applied to the photosensitive element in any location in the axial direction, there has been proposed a configuration that the pressing/biasing force is adjusted so that a pull-out force of a film placed in the position at which the photosensitive element and the developing sleeve are opposed is set within a predetermined range (for example, Japanese Patent Application Laid-open No. 2006-48018).

By the way, in recent years, for the purpose of parts recycling, devices built into an image forming apparatus are unitized, thereby improving the attachment and removal operability.

Also in the developing device described above, the attachment and removal operability is required for enabling reuse of the developing sleeve thereby achieving the price reduction; however, in conventional configurations, as for a rotating shaft of a developing sleeve, a configuration that the rotating shaft is inserted into a bearing attached to a unit thereby being supported by the bearing is frequently used, and the unit including the developing sleeve cannot be removed unless the unit is taken apart.

SUMMARY OF THE INVENTION

It is an object of the present invention to at least partially solve the problems in the conventional technology.

According to an aspect of the present invention there is provided a process cartridge that incorporates a developing device including a rotatable developer carrier for supplying a developer to an electrostatic latent image formed on a latent image carrier. The process cartridge includes: a bearing that supports a rotating shaft of the developer carrier; and a pressing unit that presses the bearing toward the latent image carrier. A notch having an opening, which extends over a part of a circumference of the rotating shaft, is formed on the bearing, and the notch portion is used as an attachment and removal portion of the rotating shaft.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
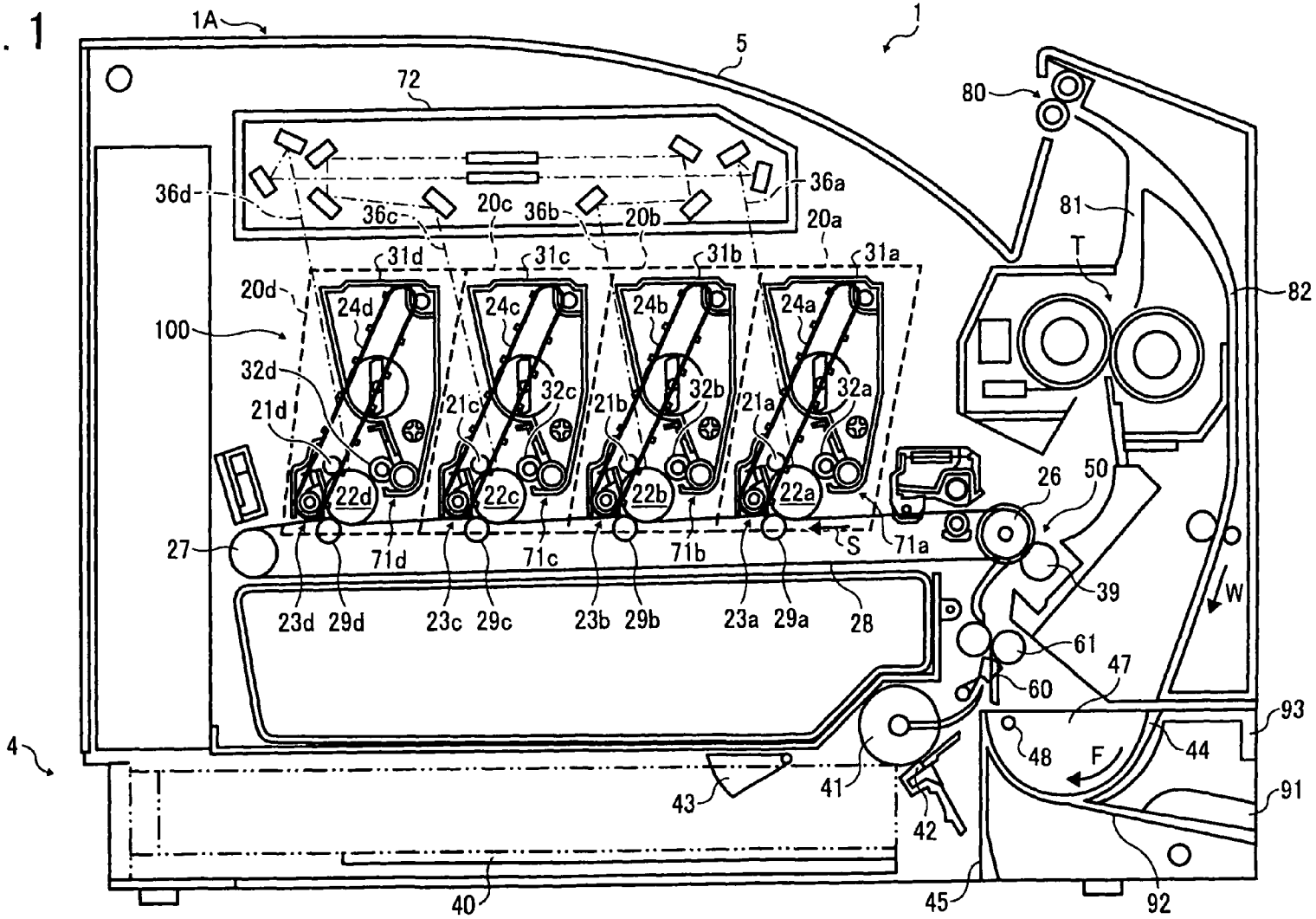
FIG. 1 is a schematic diagram for explaining a configuration of an image forming apparatus using a process cartridge according to the present invention.

An image forming apparatus shown in FIG. 1 is a color printer capable of forming a multi-color image. Incidentally, the present invention is not limited to a printer as an image forming apparatus, and the image forming apparatus includes a copier, a facsimile machine, a printing press, and a multi-function peripheral having functions of such apparatuses.

In FIG. 1, a color printer 1 includes image forming units 71*a*, 71*b*, 71*c*, and 71*d* that are process cartridges for respective colors, in each of which a photosensitive element used as an image carrier and devices that perform a charging process, a developing process, and a cleaning process with respect to the photosensitive element are housed.

The color printer 1 according to the present embodiment employs a tandem system in which the image forming units 71*a*, 71*b*, 71*c*, and 71*d* are arranged to be aligned in an extending direction of an intermediate transfer belt 28 used as an intermediate transfer body onto which images of different colors formed by the image forming units are sequentially transferred.

The color printer 1 includes an enclosure main body 1A capable of housing an image forming unit 100, and the image forming unit 100 is arranged roughly in the center of the enclosure main body 1A in a height direction of the enclosure main body 1A.

An optical scanning device 72 is arranged above the image forming unit 100. A paper feed unit 4 equipped with a paper cassette, which is a loading unit capable of loading and containing sheet-like recoding media such as recording paper (hereinafter, referred to as "recoding sheet(s)"), is arranged below the image forming unit 100.

Figure 2:
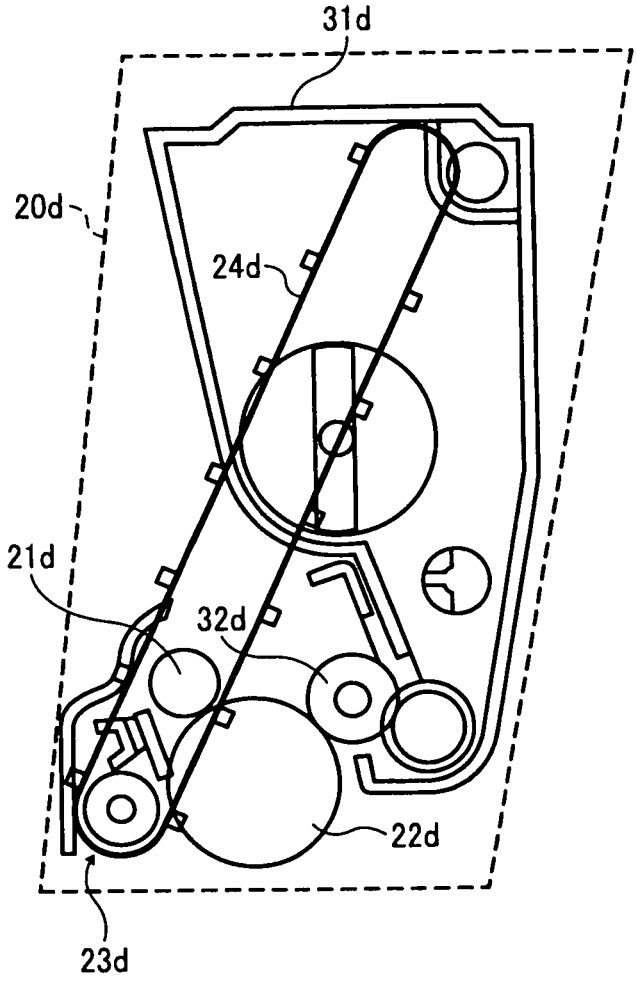
FIG. 2 is a schematic diagram for explaining a configuration of one of the process cartridges shown in FIG. 1.

Out of the image forming units 71*a*, 71*b*, 71*c*, and 71*d* used in the image forming unit 100, the image forming unit 71*d* is shown in FIG. 2 as a representative of the image forming units. The image forming units 71*a*, 71*b*, 71*c*, and 71*d* are composed of process cartridges 20*a*, 20*b*, 20*c*, and 20*d*, respectively; each of the process cartridges 20*a*, 20*b*, 20*c*, and 20*d* houses therein a drum-like photosensitive element (hereinafter, referred to as a "photosensitive drum") 22*a*, 22*b*, 22*c*, 22*d* corresponding to a latent image carrier which can rotate in a clockwise direction, a charging roller 21*a*, 21*b*, 21*c*, 21*d* which is arranged around the photosensitive drum and is in contact with the photosensitive drum, a developing device 31*a*, 31*b*, 31*c*, 31*d* which includes a developing sleeve 32*a*, 32*b*, 32*c*, 32*d* corresponding to a developer carrier and performs a visible imaging process of an electrostatic latent image formed on the photosensitive drum 22*a*, 22*b*, 22*c*, 22*d*, and a cleaning device 23*a*, 23*b*, 23*c*, 23*d* including a blade for scraping residual toner off by contact with the photosensitive drum 22*a*, 22*b*, 22*c*, 22*d*.

In each of the process cartridges 20*a*, 20*b*, 20*c*, and 20*d*, the photosensitive drum 22*a*, 22*b*, 22*c*, 22*d*, which is initialized by being uniformly charged at high potential in the dark by the charging roller 21*a*, 21*b*, 21*c*, 21*d*, is selectively exposed to a laser beam 36*a*, 36*b*, 36*c*, 36*d* from the optical scanning device 72 on the basis of image data, and an electrostatic latent image composed of a low potential portion of which the potential is decayed by the exposure and a high potential portion of which the high potential due to the initialization is maintained is formed.

The developing device 31*a*, 31*b*, 31*c*, 31*d* forms a toner image (i.e., develops the electrostatic latent image into a toner image) by performing the visible imaging process, i.e., by transferring toner to the low potential portion (or the high potential portion) of the electrostatic latent image.

The process cartridge 20*a*, 20*b*, 20*c*, 20*d* is configured to be able to contain the developing device 31*a*, 31*b*, 31*c*, 31*d* in a housing composing the process cartridge, and the photosensitive drum 22*a* to 22*d* rotates in the clockwise direction thereby moving the toner image in the circumferential direction and conveying the toner image toward a primary transfer position described below.

The latent image formation and the toner image formation by the development are performed in each of the process cartridges 20*a*, 20*b*, 20*c*, and 20*d* sequentially at each set timing, and, as described blow, images of different colors, such as cyan, magenta, yellow, and black, are sequentially primary-transferred from the image carriers onto the intermediate transfer belt 28 of which the upper extending surface is opposed to the process cartridges 20*a*, 20*b*, 20*c*, and 20*d* and moves in a direction indicated by an arrow S in FIG. 1, thereby a full-color superimposed image is carried on the intermediate transfer belt 28.

Namely, in synchronization with the timing at which the toner image transferred onto the intermediate transfer belt 28 by the image forming unit 71*a* comes to a next primary transfer site, i.e., a contact point between the intermediate transfer belt 28 and the photosensitive drum 22*b* (incidentally, a primary transfer roller 29*b* is installed on the underside of the intermediate transfer belt 28 at the contact point), the photosensitive drum 20*b* of the next image forming unit 71*b* works in the same manner as in the image forming unit 71*a*, the developing device 31*b* develops the electrostatic latent image on the photosensitive drum 22*b* into a toner image by performing the visible imaging process, the photosensitive drum 20*b* rotates and conveys the toner image, and the toner image on the photosensitive drum 20*b* is transferred onto the intermediate transfer belt 28 to be superimposed on the already-formed toner image on the intermediate transfer belt 28. The image forming units 71*c* and 71*d* perform the same operation sequentially.

Incidentally, for the development of the electrostatic latent image, an alternating current and direct current (AC/DC) superposition bias voltage of negative potential from a bias power supply (not shown here) is applied to a core metal of each developing roller 32*a*, 32*b*, 32*c*, 32*d*. Furthermore, a DC bias voltage of negative potential from another bias power supply is applied to each charging roller 21*a*, 21*b*, 21*c*, 21*d*, thereby charges the photosensitive drum. Moreover, for the primary transfer, primary transfer rollers 29*a*, 29*b*, 29*c*, and 29*d* are installed on the underside of the intermediate transfer belt 28 to have contact with the photosensitive drums 22*a*, 22*b*, 22*c*, and 22*d* across the intermediate transfer belt 28.

A difference among the process cartridges 20*a*, 20*b*, 20*c*, and 20*d* is a developer used in the developing device; as the developers, toners of different colors, such as cyan, yellow, magenta, and black, are used. In the present example, the process cartridges 20*a*, 20*b*, 20*c*, and 20*d* are arranged side by side along the intermediate transfer belt 28 strained in a lateral direction, and the photosensitive drums 22*a*, 22*b*, 22*c*, and 22*d* are also arranged side by side to be in contact with the intermediate transfer belt 28.

The intermediate transfer belt 28 used as a type of a primary transfer member has the surface extending in a horizontal direction in FIG. 1, and the four photosensitive drums 22*a*, 22*b*, 22*c*, and 22*d* are arranged along this extending surface.

A rightmost portion of the intermediate transfer belt 28 is supported by a drive roller 26 located in a manner protruding to the right-hand side of the image forming unit 100, a leftmost portion of the intermediate transfer belt 28 is supported by a driven roller 27 located on the left-hand side of the image forming unit 100, and the intermediate transfer belt 28 is driven to rotate in a counterclockwise direction. A secondary transfer roller 39 is arranged to be opposed to the drive roller 26, and a nip portion between them constitutes a secondary transfer site 50.

The intermediate transfer belt 28 is pressed with the primary transfer rollers 29*a*, 29*b*, 29*c*, and 29*d* so that the upper extending surface of the intermediate transfer belt 28 comes in contact with the photosensitive drums 22*a*, 22*b*, 22*c*, and 22*d*. The intermediate transfer belt 28 moves in circle while having contact with the photosensitive drums 22*a*, 22*b*, 22*c*, and 22*d*, and, as described above, toner images are sequentially transferred from the photosensitive drums 22*a*, 22*b*, 22*c*, and 22*d* installed in the four image forming units 71*a*, 71*b*, 71*c*, and 71*d* onto the intermediate transfer belt 28 in accordance with the movement of the intermediate transfer belt 28, thereby forms a full-color toner image, which the four toner images are superimposed on one another, on the intermediate transfer belt 28. The full-color toner image is collectively transferred onto a recording sheet at the secondary transfer site 50 via the secondary transfer roller 39.

The toner image transferred onto the recording sheet is fixed on the recording sheet by a fixing unit T, and the recording sheet is either discharged into a tray-like discharged-sheet containing unit 5 through a discharge conveyance path 81 by a discharge unit 80 composed of a pair of rollers or again circulated toward the secondary transfer site 50. In the case where the recording sheet is discharged into the discharged-sheet containing unit 5, one side of the recording sheet is subject to image recording. On the other hand, in the case where the recording sheet is circulated toward the secondary transfer site 50, both sides of the recording sheet are subject to image recording.

In the latter case, i.e., in the case of two-sided recording, the recording sheet is conveyed toward a recirculation conveyance path described below, and reversed before the recording sheet again reaches the secondary transfer site 50. A configuration of a conveying device used in a reverse conveyance path is explained below.

The conveying device includes a loading unit capable of loading and containing recording sheets and a unit that feeds a recording sheet from the loading unit, and these units compose the paper feed unit 4 arranged just below the image forming units 71*a*, 71*b*, 71*c*, and 71*d* used in the image forming unit 100.

The paper feed unit 4 includes, as the loading unit loading unused recording sheets thereon, a cassette 40 having a loading plate biased so as to be pressed upward by a biasing unit (not shown); as the unit that feeds the recording sheets loaded on the cassette 40, a feed roller 41; as a separation unit that separates one sheet from the recording sheets, a friction pad 42; a sheet presence detecting unit that detects the presence or absence of recording sheet(s) on the tray 40; a registration sensor 60 used to set the registration timing of a recording sheet fed from the tray 40 or a recording sheet introduced from a reverse path 44 described below and a registration roller 61 used to feed the recording sheet into the secondary transfer site 50 in accordance with the registration timing; a recirculation conveyance path 82 used at the time of two-sided image formation; a course switching member (not shown) used at the time of two-sided image formation; and the like.

In the present embodiment, the feed roller 41, the registration sensor 60, and the registration roller 61 are installed on the enclosure main body 1A; the cassette 40, the friction pad 42, and the reverse path 44 are configured to be able to be inserted and removed with respect to the enclosure main body 1A. Consequently, the insertion and removal can be made without causing interference with the enclosure main body 1A. Incidentally, the tray 40 can be composed of a tray (indicated by a dashed-two dotted line in FIG. 1) capable of loading large-sized recording sheets thereon.

The recirculation conveyance path 82 branches from a part of the discharge conveyance path 81 and is laterally diverted from the image forming unit 100 in the horizontal direction, and an end of the recirculation conveyance path 82 connects to the reverse path 44 which is integrally formed with the tray 40 used in the paper feed unit 4.

The reverse path 44, which connects to the recirculation conveyance path 82 and functions as a part of the recirculation conveyance path 82, is configured so that an end of the recirculation conveyance path 82 on a back-side in a moving direction of a recording sheet introduced into the recirculation conveyance path 82 merges with a path at a position in front of the registration roller 61, which corresponds to the fed position to which a recording sheet is fed from the tray 40. Therefore, the recording sheet introduced into the recirculation conveyance path 82 is conveyed toward the registration roller 61 in the same manner as a recording sheet fed from the cassette 40, and delivered to the same fed position as the recording sheet from the cassette 40.

The reverse path 44 is integrated with the cassette 40 by molding or the like as a part of the cassette 40, and conveyance surfaces opposed to the front and back sides of a recording sheet are made up of an exterior cover 92 provided to the cassette 40 in an integrated manner and a conveyance guide member 47 installed to be opposed to the exterior cover 92.

The exterior cover 92 composing one of the conveyance surfaces of the reverse path 44 is provided with a handle portion 93 as a handling unit used when the cassette 40 of the paper feed unit 4 is inserted and removed with respect to the enclosure main body 1A.

One of the conveyance surfaces of the reverse path 44 can be exposed to the outside so that the operation from the outside can be made; namely, one of the conveyance surfaces corresponds to the exterior cover 92, and by opening and closing the conveyance guide member 47, which is the other conveyance surface opposed to the one conveyance surface, with respect to the exterior cover 92 corresponding to the one conveyance surface, a part of the one conveyance surface corresponding to the exterior cover 92 can be exposed to the outside.

As a configuration for exposing one of the conveyance surfaces to the outside, a configuration in which the other conveyance surface is configured to be openable is used, and either a configuration in which the conveyance guide member 47 is turned or a configuration in which the conveyance guide member 47 is attached and removed with respect to the exterior cover 92 is used.

In the configuration in which the conveyance guide member 47 is turned, the conveyance guide member 47 is turned, around a support shaft 48 as a support point provided on the rear side in a conveying direction of a recording sheet introduced into the reverse path 44 connecting to the recirculation conveyance path 82 (in a direction indicated by an arrow F in FIG. 1), in a direction of coming close to or moving away from the conveyance surface of the exterior cover 92 corresponding to one of the conveyance surfaces. In this configuration, when the cassette 40 is inserted into the enclosure main body 1A, the base end of the conveyance guide member 47, which corresponds to the side of the support shaft 48, bumps into the insertion portion of the cassette 40 before another rotating end, which moves when the conveyance guide member 47 is turned, does. Therefore, following the insertion, the conveyance guide member 47 is turned in the direction of coming close to the side of the exterior cover 92, thereby composing the reverse path 44 capable of letting a recording sheet therethrough. As a result, even if a user dares not put the cassette 40 into the closed position, the reverse path 44 can be restored only by the insertion operation of the cassette 40. Incidentally, although it is not illustrated in the drawing, the closed position of the conveyance guide member 47, i.e., a space between the conveyance guide member 47 and the exterior cover 92 is defined by locking the rotating end of the conveyance guide member 47 with a latch part provided on the housing of the cassette 40.

On the other hand, in the configuration in which the conveyance guide member 47 is attached and removed, the conveyance guide member 47 may be composed of a cap member which can be inserted and removed with respect to the exterior cover 92. In this configuration, the conveyance guide member 47 serves as a cap member placed at the position where a predetermined space is left between the conveyance guide member 47 and the exterior cover 92, so one of the conveyance surfaces can be exposed by removing the conveyance guide member 47. Incidentally, to make sure to attach the conveyance guide member 47 serving as the cap member, although not illustrated in the drawing, an attachment completion detecting sensor, such as a push switch, can be provided on the latch part for defining the space between the conveyance guide member 47 and the exterior cover 92 so that whether the conveyance guide member 47 corresponding to the other conveyance surface is surely attached or not is determined by the detecting sensor.

Based on the image forming apparatus having the configuration described above, features of the present invention are explained below. Incidentally, in the explanation below, members common to all the image forming units are denoted by symbols only including numerals, and alphabets in the symbols are omitted.

The features of the present invention are, first of all, to prevent axial-direction distortion of the developing sleeve 32 in the developing device 31, which is one of the devices housed in the process cartridge 20, in other words, a variation in a gap between respective axial-direction ends of the developing sleeve 32 and the photosensitive drum 22 opposed to each other and, secondly, to improve the attachment and removal operability of a component built into the process cartridge.

First, the first feature is explained.

Figure 3A:
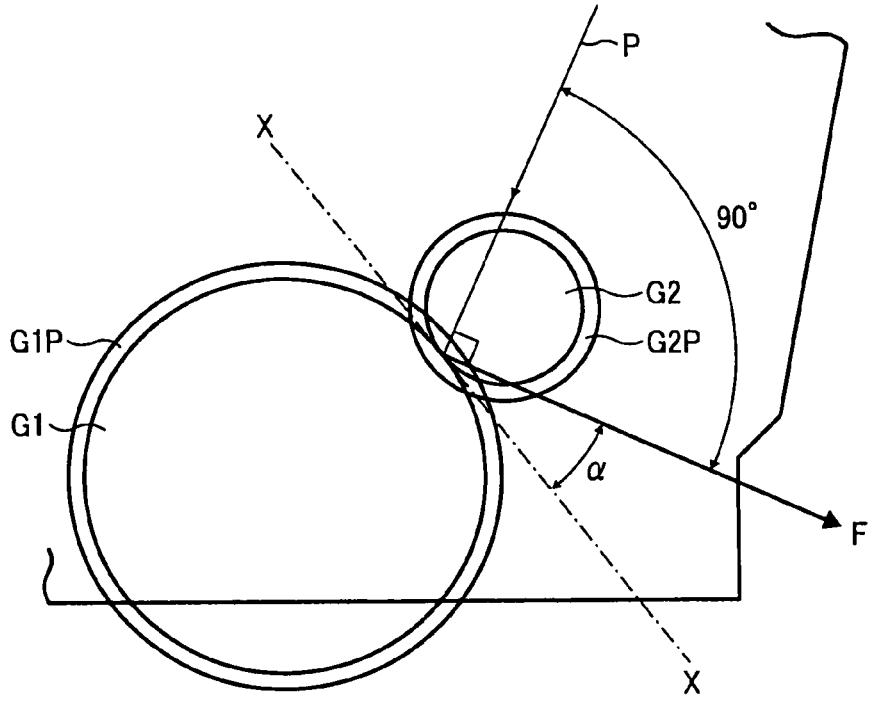
FIGS. 3A and 3B are schematic diagrams for explaining a condition for pressing/biasing a developer carrier in a developing device built into the process cartridge shown in FIG. 2.
Figure 3B:
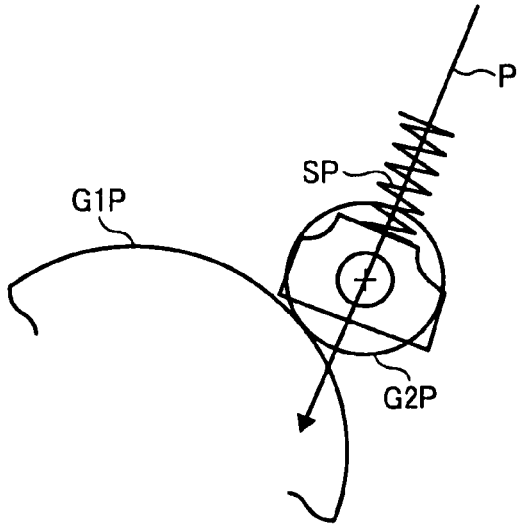

FIGS. 3A and 3B are schematic diagrams illustrating a configuration for pressing/biasing the developing sleeve 32 to the photosensitive drum 22.

In FIG. 3A, the photosensitive drum 22 and the developing sleeve 32 are configured to interlock with each other by gears G1 and G2 which are both provided on the same end side in the axial direction, respectively; a driving force F with respect to the developing sleeve 32 acts at an angle corresponding to a pressure angle of the gear G2 (an angle indicated by a in FIG. 3A) with respect to the tangent X-X set at the position where respective pitch circles G1P and G2P of the gears G1 and G2 are in contact with each other.

In the present embodiment, with respect to the driving force F, a pressing/biasing direction of the developing sleeve 32 with respect to the photosensitive drum 22 is set to a direction (a direction indicated by a symbol P) perpendicular to a direction of action of the driving force.

Consequently, a component force of the driving force in the direction perpendicular to the direction of action of the driving force is zero, and the rotating shaft of the gear G2 is prevented from being pulled back in the direction of action of the driving force F thereby preventing the axis line from being distorted between a driven end and the other end which is not driven in the axial direction of the rotating shaft, and thereby suppressing a variation in the axial-direction gap between the developing sleeve 32 and the photosensitive drum 22 caused by the distortion of the axis line.

FIG. 3B shows a state where an extending direction of an elastic body SP, such as a spring, with respect to a bearing 33 which supports a rotating shaft 32A inserted thereinto is set to the above-mentioned direction perpendicular to the direction of action of the driving force F so as to press/bias the developing sleeve 32.

Subsequently, the second feature is explained.

The second feature is achieved by a configuration of the bearing unit of the rotating shaft of the developing sleeve 32 on the basis of the configuration cited as the first feature.

Figure 4:
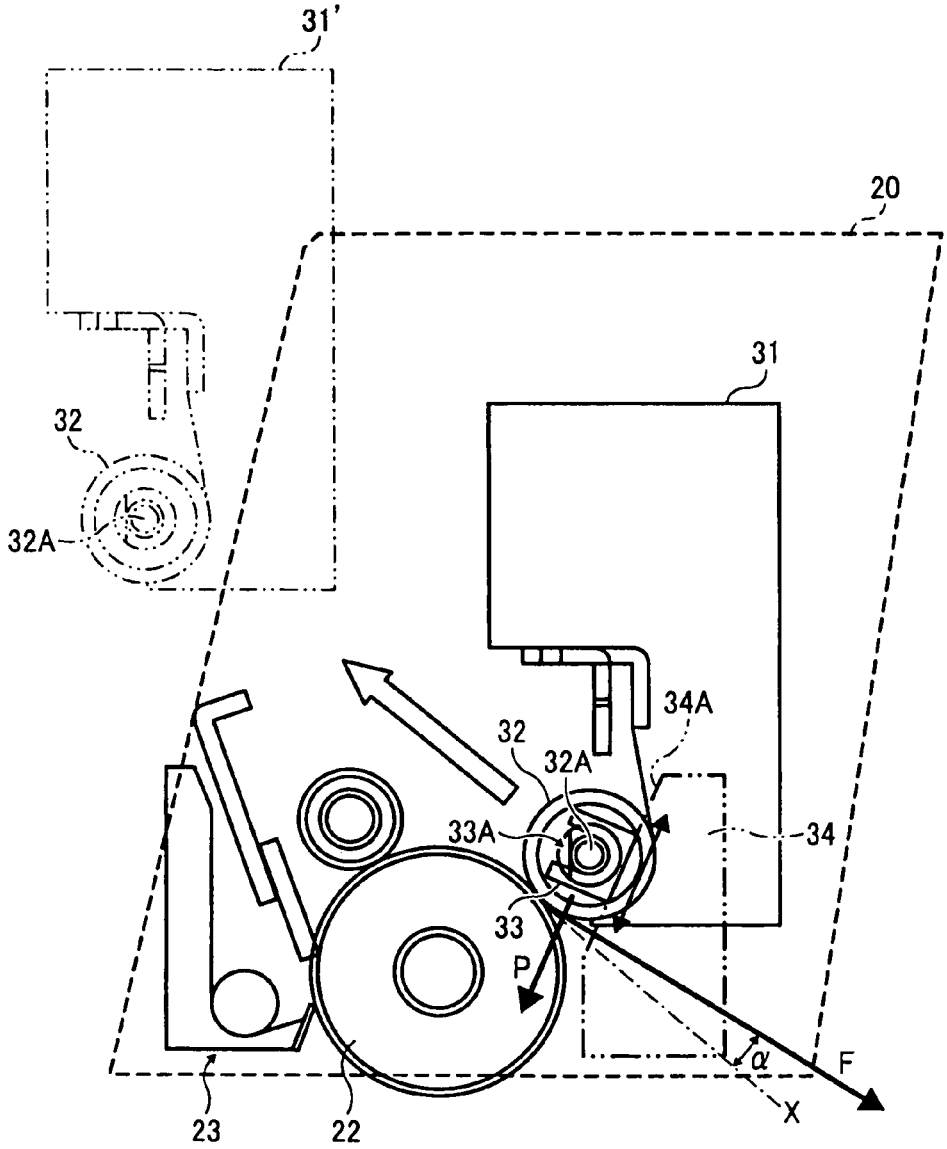
FIG. 4 is a schematic diagram for explaining an installation structure of a bearing which is a relevant component of the process cartridge according to the present invention.

FIG. 4 is a diagram illustrating a configuration for improving the attachment and removal operability of the developing device 31 built into the process cartridge 20.

In FIG. 4, the axial-direction end of the rotating shaft 32A of the developing sleeve 32, which is opposed to the photosensitive drum 22 with a predetermined gap between them left, is rotatably supported by the bearing 33.

Figure 5:
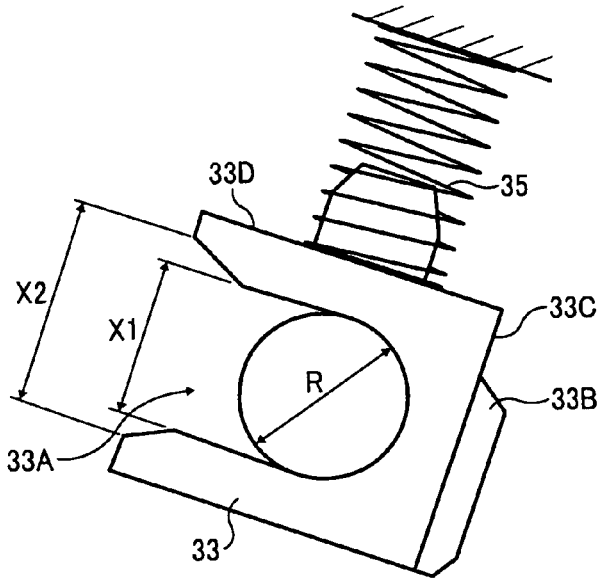
FIG. 5 is a diagram for explaining a configuration of a relevant portion of the bearing shown in FIG. 4.

As shown in FIGS. 4 and 5, the bearing 33 is a member having a rectangular contour, and is provided in the process cartridge 20. The bearing 33 slides by being guided by a guide member 34 having a guide surface 34A parallel to the pressing/biasing direction (P) of the developing sleeve 32 described in FIGS. 3A and 3B.

In a portion of the bearing 33 into which the rotating shaft 32A is inserted, a notch 33A having an opening formed on a surface of the bearing 33 on the side opposite to the guide surface 34A is formed. Incidentally, in FIG. 5, a reference numeral 33B denotes a key fitted into a guide groove (not shown) formed on the guide surface 34A of the guide member 34.

The notch 33A has a longitudinal direction parallel to a direction in which the developing sleeve 32 is attached and removed and which corresponds to a direction perpendicular to the guide surface 34A, and thus is a portion used as an attachment and removal portion of the rotating shaft 32A. In the longitudinal direction extending from the support position of the rotating shaft 32A to the opening, notch widths along the circumferential direction of the rotating shaft 32A are set to have the following relation.

When an outer diameter of the rotating shaft 32A is denoted by R; a notch width along the circumferential direction of the rotating shaft 32A at the position where the opening is formed on the outer surface of the bearing is denoted by X2; and a notch width along the circumferential direction of the rotating shaft 32A in mid-course from the support position of the rotating shaft 32A to the opening is denoted by X1, a relation of "X2>X1>R" is set.

By such a relation, the notch width at the opening located on the outer surface of the bearing 33 is greater than a notch width at a part extending in a direction in which the rotating shaft 32A is attached and removed through the opening, so the sloped surface, by which the notch width is expanded so as to be greater at a position closer to the opening, compared to at the support position of the rotating shaft 32A, is formed near the opening, and thus, it is easier to take the rotating shaft 32A in and out at the time of attachment and removal of the rotating shaft 32A.

As shown in FIG. 5, the bearing 33 has four or more surfaces including a sliding surface 33C parallel to the guide surface 34A of the guide member 34, a surface 33D subject to a bias from an elastic body 35 which applies a pressing/biasing force to the bearing 33 in a direction that is parallel to a direction, in which the guide surface 34A is formed, and perpendicular to the sliding surface 33C, and a rotating-shaft sliding surface corresponding to an inner surface of the notch 33A. To prevent the elastic body 35 from coming off from the bearing 33, an end of the elastic body 35 in a longitudinal direction is inserted into a dowel portion formed on the surface 33D subject to the pressing/biasing force.

The bearing 33 has such a shape and, especially, has the sliding surface 33C and the surface 33D that is subject to the pressing/biasing force and is perpendicular to the sliding surface 33C, so the bearing 33 can be slid in the pressing/biasing direction described in FIGS. 3A and 3B.

Figure 6:
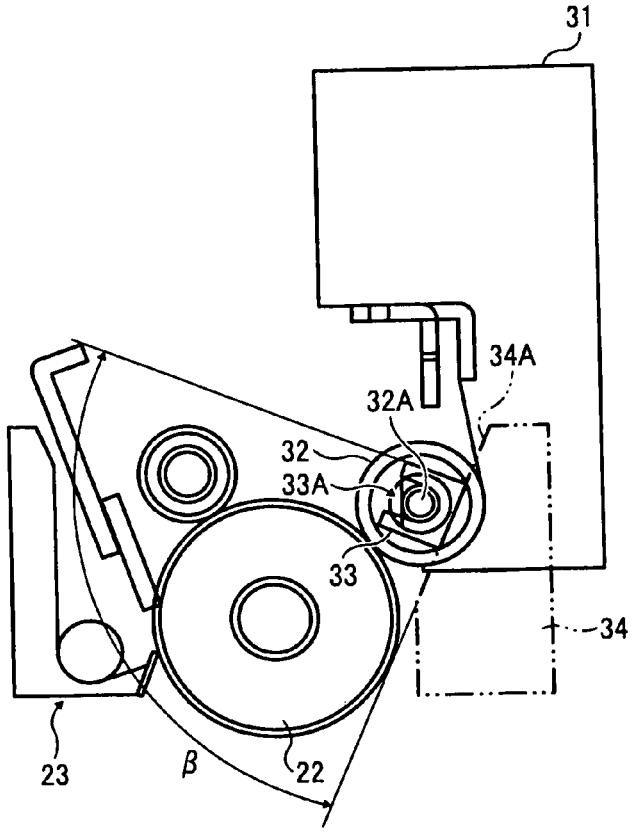
FIG. 6 is a diagram for explaining a condition of the configuration of the relevant portion of the bearing shown in FIG. 4.

The notch 33B described above is, as shown in FIG. 6, provided within a range between the sliding surface 33C of the bearing 33 and the surface 33D subject to the pressing/biasing force, which corresponds to the surface perpendicular to the sliding surface 33C, (inside of an angle indicated by a symbol β in FIG. 6). This is because the direction of the sliding surface 33C corresponds to the pressing/biasing direction (P) described in FIGS. 3A and 3B, so the bearing 33 can be moved in a state where no component force from the pressing/biasing force is generated in a direction other than the pressing/biasing direction. Consequently, a state where no distortion occurs in the axis line of the developing sleeve 32 can be maintained, and the gap between the developing sleeve 32 and the opposed photosensitive drum 22 can be surely prevented from varying in the axial direction of the developing sleeve 32.

Subsequently, a variation of the relevant part of the above embodiment is explained.

Figure 7:
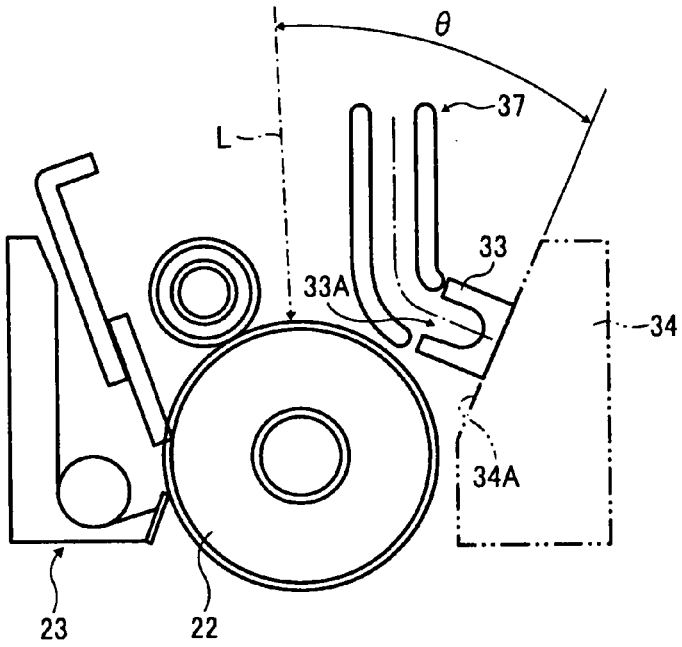
FIG. 7 is a diagram for explaining a variation of the relevant portion of the bearing shown in FIG. 4.

FIG. 7 features a point that a guide member 37 connecting to a path, along which the rotating shaft 32A is attached and removed through the notch 33A, is provided near the notch 33A of the bearing 33.

The guide member 37 does not extend along the direction of the longitudinal direction of the notch 33A but is arranged between the sliding surface 33C of the bearing 33 and a write optical path L. This enables attachment and removal of the rotating shaft 32A while preventing the guide member 37 from interfering with the write optical path L.

Figure 8:
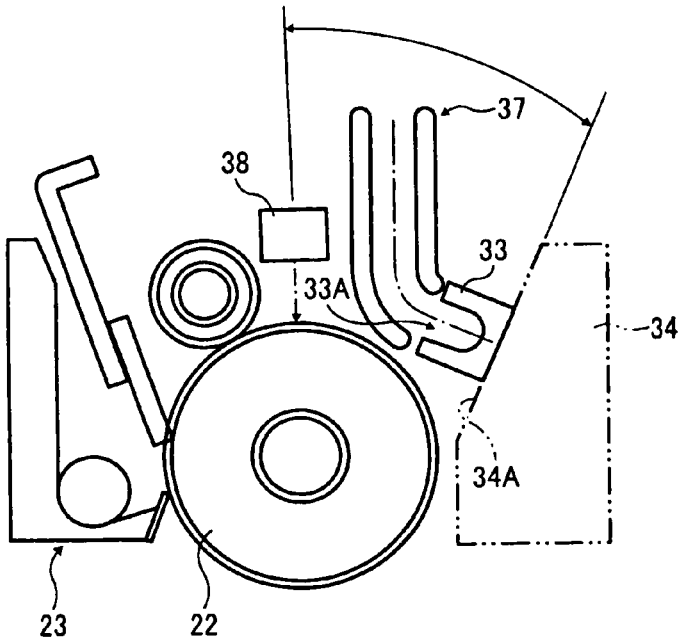
FIG. 8 is a diagram showing a partial variation of the relevant portion of the bearing according to the variation shown in FIG. 7.

In the installation configuration of such a guide member 37, as shown in FIG. 8, an LED 38, which is a light source, can be installed instead of the write optical path L.

In the embodiment described above, on the premise of the configuration for maintaining the state where distortion of the developing sleeve in the direction of the axis line is prevented, the attachment and removal operability of the developing sleeve can be improved.

According to the present embodiment, as a condition for pressing/biasing a developer carrier toward a latent image carrier, the developer carrier is pressed/biased in a direction perpendicular to a direction of action of a driving force to the developer carrier, thereby, for example, when a gear is used to drive the developer carrier, axis line of the developer carrier is prevented to be distorted at a drive-side end of the developer carrier, and it is possible to suppress a variation in a gap between the developer carrier and the opposed latent image carrier throughout the whole area of the developer carrier in the axial direction.

In addition, on a bearing used to maintain this state, a notch portion for attachment and removal of a rotating shaft of the developer carrier is formed, so the operation for attachment and removal of a developing device can be made without taking a process cartridge apart.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A process cartridge that incorporates a developing device including a rotatable developer carrier for supplying a developer to an electrostatic latent image formed on a latent image carrier, the process cartridge comprising:

a bearing that supports a rotating shaft of the developer carrier;

a pressing unit that presses the bearing toward the latent image carrier, wherein a notch having an opening, which extends over a part of a circumference of the rotating shaft, is formed on the bearing, and the notch portion is used as an attachment and removal portion of the rotating shaft; and a guide surface parallel to a pressing direction of the pressing unit, wherein the notch portion is formed on a side opposite to the guide surface.

2. The process cartridge according to claim 1, wherein the bearing has four or more surfaces including a surface subject to a pressing/biasing force from the pressing unit, a sliding surface which is placed perpendicular to the surface subject to the pressing/biasing force and along a pressing/biasing direction, and a rotating-shaft sliding surface corresponding to the notch portion.

3. The process cartridge according to claim 2, wherein the opening of the notch portion of the bearing is located inside of an angle β formed between the surface subject to the pressing/biasing force and the sliding surface.

4. The process cartridge according to claim 1, further comprising a guide unit that guides the rotating shaft, the guide unit being provided near the notch portion and connecting to the opening of the notch portion.

5. The process cartridge according to claim 4, wherein the guide unit is arranged inside of an angle formed between the sliding surface of the bearing and a path of light for writing a latent image on the latent image carrier.

6. An image forming apparatus using the process cartridge of claim 1.

7. A process cartridge that incorporates a developing device including a rotatable developer carrier for supplying a developer to an electrostatic latent image formed on a latent image carrier, the process cartridge comprising:

a bearing that supports a rotating shaft of the developer carrier; and a pressing unit that presses the bearing toward the latent image carrier, wherein a notch having an opening, which extends over a part of a circumference of the rotating shaft, is formed on the bearing, and the notch portion is used as an attachment and removal portion of the rotating shaft, wherein a direction of attachment and removal of the rotating shaft is a direction perpendicular to a pressing direction of the pressing unit.

8. The process cartridge according to claim 7, wherein the notch portion has a longitudinal direction along which the rotating shaft is attached and removed, and as for a notch width along the circumferential direction of the rotating shaft corresponding to a width in a direction perpendicular to the longitudinal direction, when an outer diameter of the rotating shaft is denoted by R, the notch width along the circumferential direction of the rotating shaft at an outer surface of the bearing is denoted by X2, and the notch width along the circumferential direction of the rotating shaft in mid-course from an insertion portion of the rotating shaft in the bearing to the outer surface is denoted by X1, a relation of "X2>X1>R" is set.

9. The process cartridge according to claim 7, wherein as a condition for pressing/biasing the developer carrier toward the latent image carrier, a condition that the developer carrier is pressed/biased in a direction perpendicular to a direction of action of a driving force to the developer carrier at a position where the developer carrier is opposed to the latent image carrier is set.

10. The process cartridge according to claim 7, further comprising a guide unit that guides the rotating shaft, the guide unit being provided near the notch portion and connecting to the opening of the notch portion.

11. The process cartridge according to claim 10, wherein the guide unit is arranged inside of an angle formed between the sliding surface of the bearing and a path of light for writing a latent image on the latent image carrier.

12. An image forming apparatus using the process cartridge of claim 7.

13. A process cartridge that incorporates a developing device including a rotatable developer carrier for supplying a developer to an electrostatic latent image formed on a latent image carrier, the process cartridge comprising:

a bearing that supports a rotating shaft of the developer carrier; and a pressing unit that presses the bearing toward the latent image carrier, wherein a notch having an opening, which extends over a part of a circumference of the rotating shaft, is formed on the bearing, and the notch portion is used as an attachment and removal portion of the rotating shaft, wherein the notch is formed in a direction opposite to a direction of action of a driving force to a developer carrier at a position where the developer carrier is opposed to the latent image carrier.

14. The process cartridge according to claim 13, wherein a direction of attachment and removal of the rotating shaft is a direction perpendicular to a pressing direction of the pressing unit.

15. The process cartridge according to claim 13, wherein as a condition for pressing/biasing the developer carrier toward the latent image carrier, a condition that the developer carrier is pressed/biased in a direction perpendicular to a direction of action of a driving force to the developer carrier at a position where the developer carrier is opposed to the latent image carrier is set.

16. The process cartridge according to claim 13, further comprising a guide unit that guides the rotating shaft, the guide unit being provided near the notch portion and connecting to the opening of the notch portion.

17. The process cartridge according to claim 16, wherein the guide unit is arranged inside of an angle formed between the sliding surface of the bearing and a path of light for writing a latent image on the latent image carrier.

18. An image forming apparatus using the process cartridge of claim 13.

* * * * *